United States Patent [19]

Schoen

[11] Patent Number: 4,660,959

[45] Date of Patent: Apr. 28, 1987

[54] DEVICE FOR THE ELECTROPHOTOGRAPHIC MANUFACTURE OF PRINTING FORMS

[75] Inventor: Klaus-Peter Schoen, Wiesbaden, Fed. Rep. of Germany

[73] Assignee: Hoechst Sktiengesellschaft, Frankfurt am Main, Fed. Rep. of Germany

[21] Appl. No.: 798,118

[22] Filed: Nov. 14, 1985

[30] Foreign Application Priority Data

Nov. 23, 1984 [DE] Fed. Rep. of Germany ..... 3442755

[51] Int. Cl.[4] ..... G03G 15/00

[52] U.S. Cl. ..... 355/3 R; 355/35 H; 355/73; 406/88

[58] Field of Search ..... 355/3 R, 35 H, 145 H, 355/73, 76; 406/88, 89; 271/195

[56] References Cited

U.S. PATENT DOCUMENTS

| | | | |
|---|---|---|---|
| 3,617,127 | 11/1971 | McDuff | 355/73 |
| 4,006,984 | 2/1977 | Friese . | |
| 4,226,526 | 10/1980 | Spence-Bate et al. | 355/76 X |
| 4,334,472 | 6/1982 | Back et al. . | |
| 4,371,309 | 2/1983 | Principe et al. | 406/88 X |
| 4,402,592 | 9/1983 | Schoen et al. . | |
| 4,462,678 | 7/1984 | Back . | |

OTHER PUBLICATIONS

*IBM Technical Disclosure Bulletin,* vol. 21, No. 1, Jun. 1978, Gagne et al., "Device Air Transport System", pp. 84–85.

*Primary Examiner*—Arthur T. Grimley
*Assistant Examiner*—J. Pendegrass
*Attorney, Agent, or Firm*—Schwartz, Jeffery, Schwaab, Mack, Blumenthal & Evans

[57] ABSTRACT

Disclosed is a device for the electrophotographic manufacture of printing forms, comprising a loading table, an exposure table and a developing table arranged in the device one after the other in the transport direction A of printing plates. The loading table is pivotable and is equipped with spring suction devices, by means of which the uppermost printing plate can be removed from a plate magazine. After the printing plate has been removed, the loading table is swung into its horizontal position, a corona is moved over the loading table and the photoconductive layer of the printing plate is loaded to the required voltage. The printing plate is transported from the loading table to the exposure table and from the latter to the developing table by means of compressed air which forms a cushion underneath the printing plate. The printing plate is guided on the cushion in suspension from processing station to procesing station. For this purpose, at least two rows of air nozzles are arranged in the tables of the processing stations. The air nozzles extend at an angle inside the tables and are charged with compressed air. The loading table, at its narrow sides, is equipped with pivotable flaps. The exposure table, at its narrow sides, has fixed guide plates, whereas the developing table is equipped on all four sides with pivotable flaps and, moreover, has two additional rows of air nozzles which are arranged at right anges to the air nozzles which extend along each of the tables in the transport direction.

15 Claims, 8 Drawing Figures

DEVICE FOR THE ELECTROPHOTOGRAPHIC MANUFACTURE OF PRINTING FORMS

BACKGROUND OF THE INVENTION

The present invention relates to a device for the electrophotographic manufacture of printing forms which are stacked in the non-exposed condition in a magazine and are individually removed from the magazine by means of suction elements and transported to a loading station in order to be moved therefrom to further processing stations of the device.

Such a device is disclosed in German Offenlegungsschrift No. 3,012,815 (corresponding to U.S. Pat. No. 4,402,592). The disclosed device has a lifting cylinder which is pivotable about an axis and has a piston rod which can be extended out of and retracted into the lifting cylinder and which carries suction elements for sucking in and depositing the uppermost printing plate of the stack. The suction elements act on the uncoated side of the printing form. The suction elements for sucking in, securing and depositing the printing form onto a horizontal conveyor track are arranged on a dish-shaped plate which is connected as a holder of the suction elements to the piston rod. The conveyor track is a table, along which the printing form is transported to an exposure table arranged behind the table. The magazine is inclined to the perpendicular, with the lifting cylinder, in its receiving position, being directed perpendicularly towards the uncoated side of the uppermost printing form. The dish-shaped plate extends parallel to the uncoated side of the printing form and lowers onto the printing form until the suction elements sit on the latter for lifting the uppermost plate from the stack.

An apparatus for the electrophotographic manufacture of printing forms is described in German Patent Specification No. 2,462,216 (a divisional case of German Application No. 24 52 979.1 which corresponds to U.S. Pat. No. 4,006,984). In this apparatus, the individual printing form is lifted from a stack in a plate magazine by a transport device which consists of a transport carriage having a vacuum suction device and which transports the printing form to an exposure platform. The transport carriage runs over two guide rails and is driven by a motor which is arranged on the upper side and is in engagement with a gear having a rack-and-pinion drive which is arranged parallel to the motion direction of the transport carriage. On the underside, the transport carriage has a vacuum plate which is connected to a vacuum pump via a number of holes. When the transport carriage is placed onto the upper side of the uppermost printing plate in the plate magazine, the printing plate is sucked in towards the vacuum plate by vacuum. The transport carriage is then conveyed towards the exposure platform. The transport carriage is lowered onto the exposure platform and the printing plate is deposited onto the exposure platform by releasing the vacuum in the vacuum plate of the transport carriage. The exposure platform comprises a vacuum plate which is charged with vacuum in order to suck in the printing plate.

A device is disclosed in German Offenlegungsschrift. No. 3,012,761, corresponding to U.S. Pat. No. 4,334,472, by means of which a printing plate, which is lowered through a circular path of motion from above onto a support surface and the photoconductive, coated side of which is directed upwards, is transferred for further transport onto a device, equipped with rollers.

The printing plate does not lie on the rollers and the photoconductive layer of the printing plate does not contact the rollers. For this purpose, a pivotable lifting cylinder removes the printing form, in the configuration of a printing plate, from a magazine and places the printing plate, circularly with the front part, onto a suction plate of the exposure table. A row of transport and drive rollers is, in each case, arranged parallel to the two side edges of the printing plate in the transport direction, with the transport rollers lying first in the transport direction of the printing plate being pivotable outwards out of the rows to enable the front part of the printing plate to be deposited onto the suction plate of the exposure table without jamming. Once the printing plate is deposited on the exposure table, the roller strips which are parallel to one another sit with the transport and drive rollers against the side edges of the printing plate and center the latter during exposure. Since the rollers have a certain groove depth, they project by this groove depth, in the inside of the printing plate, at the border or at the side edges of the latter, so that exposure of the printing plate towards the border is not possible.

A draw-in and transport device for printing plates is described in German Offenlegungsschrift No. 3,122,321 (which corresponds to U.S. Pat. No. 4,462,678). The device enables the printing plate to be exposed over its entire width up to the outer edges. The rollers are rotatably mounted on brackets which are fixed on two movable roller strips which are parallel to one another. Also, devices are provided to outwardly displace the roller strips parallel to the side edges of the printing plate before exposure.

The known draw-in and transport devices work mechanically and comprise either a transport carriage which secures the printing plate by vacuum and conveys the individual printing plate from processing station to processing station, or driven transport rollers which are in contact with the side edges of the printing plate to transport the latter further. These devices work satisfactorily but are of expensive mechanical construction and, their transport capacity is limited to about 60 plates per minute. A higher throughput of plates can hardly be achieved, because, as a result of the sluggishness of the mechanical parts of the transport device, putting the latter into operation and stopping it for receiving a printing plate from a table of a processing station and the transfer of an individual printing plate from processing station to processing station do not permit a higher operating frequency.

SUMMARY OF THE INVENTION

Therefore, an object of the present invention is to provide an improved device for the electrophotographic manufacture of printing forms which allows for a higher transport speed for printing forms without impairing the transport reliability.

Another object of the present invention is to produce a device of the above type which is less expensive than the existing devices.

Yet another object of the present invention is to provide an improved method for the electrophotographic manufacture of printing forms.

Thus, in accordance with one aspect of the present invention, there is provided a device for the electrophotographic manufacture of printing forms which are stacked in the form of printing plates in the non-exposed condition in a magazine, individually removed from the magazine and transported to a loading station and subsequently to further processing stations, comprising a plurality of tables sequentially aligned in the direction of transport of the printing plate, and a first set of at least two rows of air nozzles obliquely positioned in each of the plurality of tables, the air nozzles being charged with compressed air.

In a preferred embodiment of the invention, the two rows of air nozzles in the surface of each table are aligned parallel to the transport direction of the printing plate or parallel to the narrow sides of the tables, and, moreover, two further rows of air nozzles are available in the table of the development station, which extend at right angles to the two rows of air nozzles. The obliquely passing air nozzles are spacially arranged in such a way that the projections of the air nozzles of the two rows into the base plane parallel to the table surface subtend and angle between about 40° and 50° with the transport direction of the printing plate. These projections are directed at this angle towards the associated narrow sides of the individual table. Moreover, the projections of the air nozzles of the two rows into a plane parallel to the longitudinal sides of the individual table subtend an angle between about 40° and 50° with the perpendicular direction towards the transport direction of the printing plate.

To stabilize the air cushion on which the individual printing plate is guided from processing station to processing station, the table of the loading station and the table of the development station are equipped with pivotable flaps which are arranged along the narrow sides of the individual table in such a way that the distance d between the flaps, raised to stand on their longitudinal edges, and the associated narrow side is about 3–6 mm. The table of the exposure station does not have any pivotable flaps, but instead, has positionally fixed guide plates along the narrow sides of the table. These guide plates, with the narrow sides of the exposure station, enclose air channels which have a width of about 3–6 mm and a depth of about 5–10 mm.

In a further development of the present invention, the distance between the two rows of air nozzles is about 35–50% of the distance between the raised flaps or the positionally fixed guide plates. The table of the development station, in addition to the flaps at the narrow sides, is equipped with pivotable flaps at the transverse sides.

To exactly position the printing plate for further processing on the table of the respective processing station, and adjustable brake is in each case arranged at one of the longitudinal sides of the tables of the exposure and development station. The brake comprises two pressure cylinders which are articulated on bearing brackets of an angled mounting bar of the brake. The mounting bar is fixed to a distance piece which is connected to the underside of the respective table.

In accordance with another aspect of the present invention there has been provided a method for the electrophotographic manufacture of printing forms which are stacked in the form of printing plates in the non-exposed condition in a magazine, comprising the steps of positioning a printing plate on a loading table; and transporting the printing plate from the loading table to an exposure table and from the exposure table to a developing table by an air cushion between the plates and the tables, wherein the air cushion is produced by obliquely positioned air nozzles in the plates.

Other objects, features and advantages of the present invention will become more apparent from a review of the detailed description of preferred embodiments, when considered with the attached figures of drawing.

DETAILED DESCRIPTION OF THE PREFERRED EMBODIMENTS

The objects according to the present invention are achieved by moving the individual printing form, in the configuration of a printing plate, in suspension by means of compressed air from one processing station to the next processing station at a distance from the surface of the tables of the processing stations. At least two rows of air nozzles are arranged in the tables. The air nozzles run at an angle inside the tables and are charged with compressed air.

Figure 1:
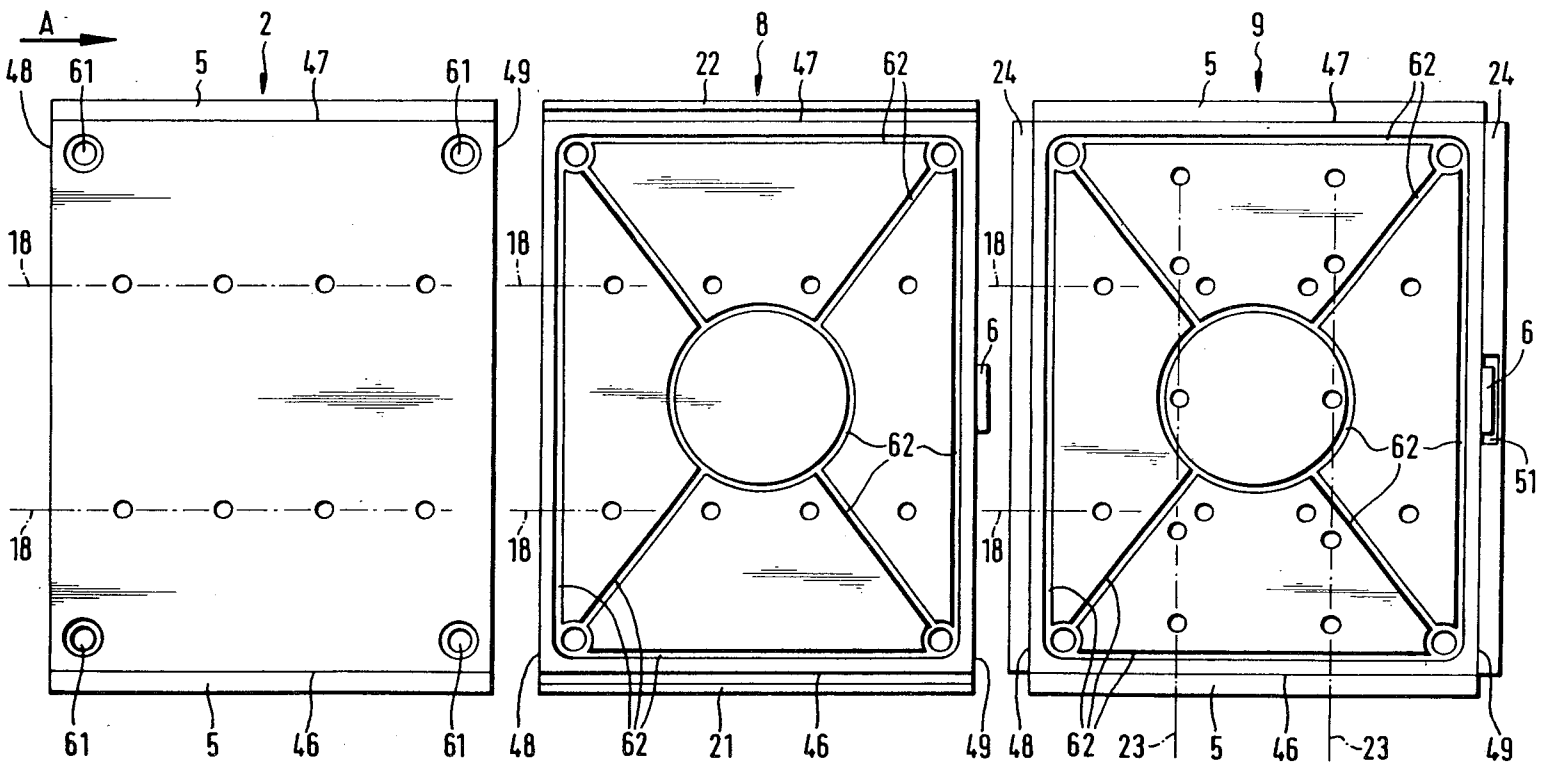
FIG. 1 shows a schematic plan view of the tables of three processing stations of an exposure and developing device according to the present invention for manufacturing printing plates.

The schematic plan view according to FIG. 1 shows a loading table 2, an exposure table 8 and a developing table 9 of the loading, exposure and developing stations. A printing form in the configuration of a printing plate is transported in the transport direction A from one processing station to the next processing station, as will be described later in greater detail. Pivotable flaps 5 are attached to the narrow sides 46 and 47 of the loading tables 2. The flaps are shown in FIG. 1 in the horizontally swung-out position in which they lie in the plane of the loading tables 2. Two rows of air nozzles 18 are arranged in each of the tables 2, 8 and 9. The nozzles 18 run at an angle inside the tables and can be charged with compressed air. As a result of compressed air, an air cushion develops beneath the printing plate, on which the printing plate is guided in suspension at a distance from the surfaces of the tables 2, 8 and 9 from one processing station to the next processing station. A spring suction device 61 is arranged in the loading table 2 near to each corner of the latter. The piston upper side of the spring suction device 61, depending on the position of the piston, is either in alignment with the surface of the loading table 2 or lies slightly beneath the surface. By means of the spring suction device 61, the printing plate is sucked in, firmly held and raised from the loading table 2 as soon as it is to be transported from the loading station to the exposure station.

The two rows of air nozzles 18 in the surfaces of the tables 2, 8 and 9, with the rows being understood as the openings of the air nozzles in the table surfaces, run parallel to the transport direction A of the printing plate or parallel to the narrow sides of the tables.

The exposure table 8 is equipped on its narrow sides 46 and 47 with positionally fixed guide plates 21 and 22. An adjustable brake 6, which will be described below in greater detail, is located in the center of the longitudinal edge 49 of the exposure table 8. The longitudinal edge 49 is located at the rear of the exposure plate in the transport direction A. A network of connected vacuum channels 62 is provided in the surface of the exposure table 8. The vacuum channels 62 are connected to a vacuum device (not shown) which produces an appropriate vacuum for sucking in and securing a printing plate on the exposure table 8.

In addition to the pivotable flaps 5 along its narrow sides 46 and 47, the developing table 9 is equipped with pivotable flaps 24 which are arranged along the longitudinal surface of the developing table 9 are arranged two further rows of air nozzles 23 which run at right angles to the two rows of air nozzles 18. The air nozzles 23 enable further transport of the developed printing plate at a right angle to the transport direction A. Located in the surface of the developing table 9 is a system of vacuum channels 62 which is largely identical to the network of vacuum channels in the exposure table 8. Opposite the center of the rear longitudinal side 49 of the devloping table 9 is a further adjustable brake 6. The flap 24 located at this longitudinal side 49 has a recess 51 for the brake 6.

Figure 2:
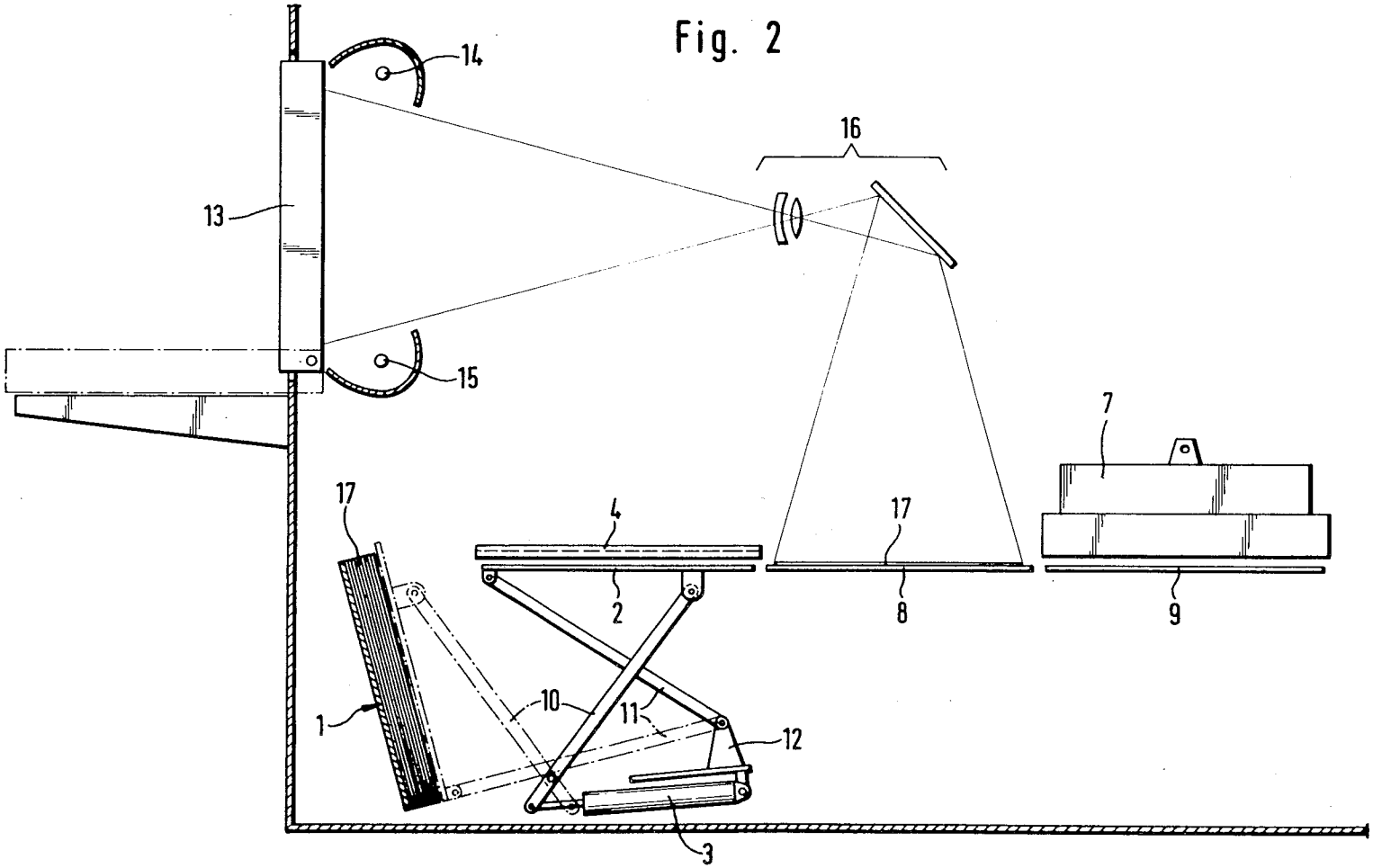
FIG. 2 shows a schematic sectional view of a device according to the present invention.

The mode of operation of the device is described by reference to the schematic partial section of the device shown in FIG. 2. A stack of printing plates 17 is located in a plate magazine 1 which is arranged at an angle to the horizontal. The upper edge of the stack or the uppermost printing plate 17 of the stack is always held at the same level by means of a drive device (not shown). The photoconductive coating of the individual printing plate 17, which coating points towards the inside of the plate magazine 1, is covered by a foil or paper blank which is removed when the printing plate 17 is removed from the plate magazine 1. To bring a printing plate 17 into the operating sequence, the loading table 2 is brought by means of a swivelling mechanism into the position indicated by chain-dotted lines. This swivelling mechanism consists of a cylinder 3, the piston rod of which is connected to one end of a coupling bar 10 which can be swivelled about a fixed point and, with its other end, is articulated on the underside of the loading table 2. A further coupling bar 11 is articulated on a fixed point 12 on the one hand and on the underside of the loading table on the other hand. If the piston rod of the cylinder 3 is retracted, the loading table 2, as already mentioned, is brought into the position indicated by chain-dotted lines in which the spring suction devices 61 grip the uppermost printing plate in the plate magazine 1 and pull it to the table surface. The piston rod of the cylinder 3 is then extended, so that the loading table 2 is swung into the horizontal loading position. During this procedure, the printing plate 17 is also sucked in towards the surface of the loading table 2 by means of the spring suction devices 61. In the loading position, the flaps 5 along the narrow sides 46 and 47 of the loading table 2 are swung into the plane of the loading table 2, so that a corona 4, at a slight distance from the printing plate 17, can move without hindrance over the full length of the printing plate 17 to load the photoconductive layer of the printing plate 17 to the necessary voltage. After the loading operation, the flaps 5 are placed upright, that is, perpendicularly to the surface of the loading table 2, and the vacuum of the spring suction devices 61 is released, so that, when the air nozzles 18 are charged with compressed or transport air, the air cushion which develops lifts the printing plate 17 from the surface of the loading table 2 and transports it in suspension in the direction of the exposure table 8. The brake 6 (cf. FIG. 1), which is arranged on one longitudinal side 49 of the exposure table 8, stops the movement of the printing plate 17. The printing plate 17 is guided by the fixed guide plates 21 and 22 of the exposure table 8 and aligned, with the distance of these guide plates from one another being about 1 mm greater than the length of the printing plate 17.

After the aligned printing plate 17 has been stopped, the transport or compressed air of the air nozzles 18 of the exposure table 8 is switched off, the brake 6 is swung down into a position lower than the surface of the exposure table 8 and the vacuum channels 62 of the exposure table 8 are charged with vacuum, so that the printing plate 17 is sucked in. The printing plate 17 is then exposed through an original (not shown) which is inserted into an original holder 13 known per se. The light sources 14 and 15 reproduce the copy via an image-reproducing optical system 16 onto the printing plate 17 sitting on the exposure table 8. The exposure time is controlled according to the required residual loading voltage which is measured by means of a suitable probe (not shown), and the exposure is terminated as soon as the residual loading voltage has been reached. The vacuum in the system of the vacuum channels 62 of the exposure table 8 is released, and the transport or compressed air of the air nozzles 18 of the exposure table 8 and the developing table 9 is switched on, so that the printing plate 17 can be transported further in suspension in the direction of the developing table 9. The flaps 5 along the narrow sides 46 and 47 of the developing table 9 are at the same time swung upright.

The further brake 6 which is arranged on one longitudinal side 49 of the developing table 9 at the location at which the pivotable flap 24 has the recess 51 (cf. FIG. 1) stops the printing plate 17 in its final position. The transport or compressed air of the air nozzles 18 is switched off and a vacuum is set up in the system of vacuum channels 62, by which means the printing plate is sucked in towards the surface of the developing table 9. A developing device 7 which contains dry toner is moved over the exposed printing plate 17 and the latent image is developed by the dry toner. In the final position of the developing device 7, the vacuum in the vacuum channels 62 is released, the flaps 24 at the longitudinal sides of the exposure table 9 are swung up and the transport or compressed air for the air nozzles 23 is switched on. The two rows of air nozzles 23 run at a right angle to the rows of air nozzles 18, so that the printing plate 17 is transported out of the device in the direction of the initial position of the developing device 7. After the printing plate 17 has left the developing table 9, the flaps 24 are swung down and the developing device 7 is returned into its initial position. A further printing plate, which is already loaded and exposed, is positioned on the developing table 9 and the developing operation is started.

Figure 3:
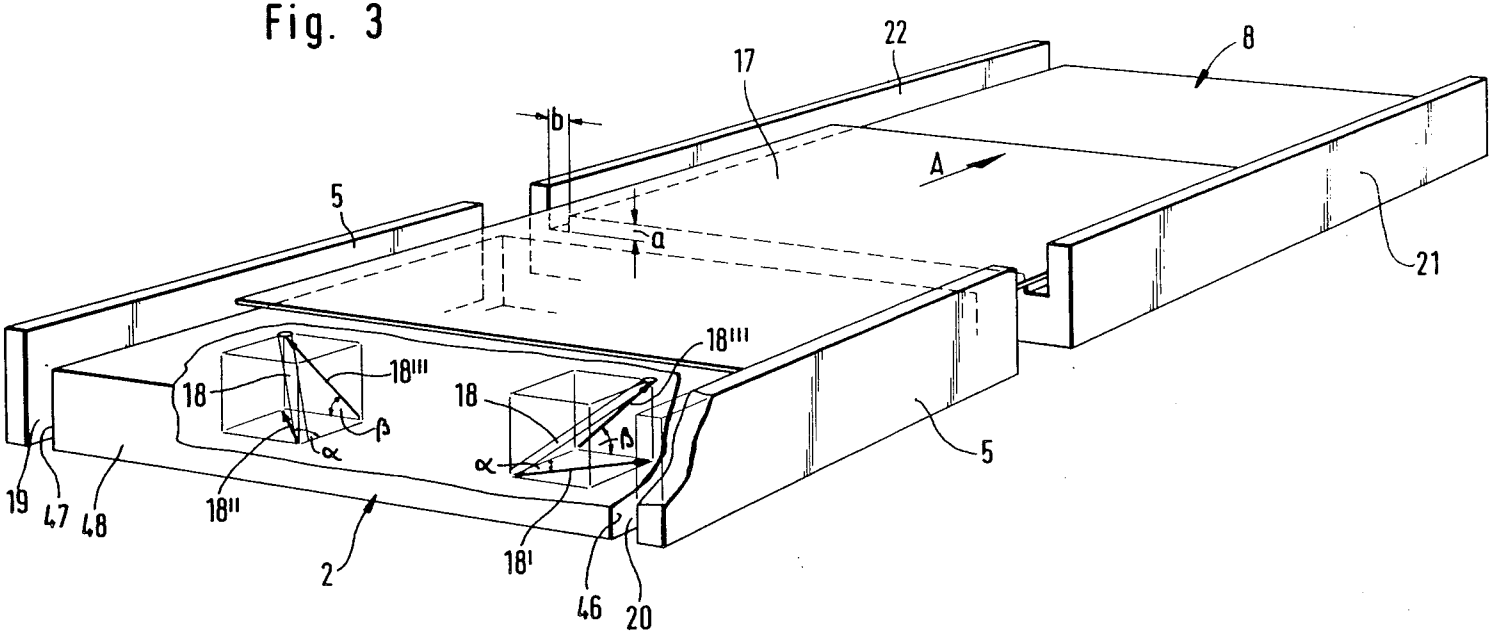
FIG. 3 shows a perspective view of the tables of the loading and exposure station of the present device.

From FIG. 3 can be seen the transfer of a printing plate from the loading table 2 onto the exposure table 8. The loading table 2 is shown cut away in the area of the two rows of air nozzles 18. The projections of the air nozzles 18, in two planes perpendicular to one another, are shown only by lines instead of 2-dimensionally for the sake of a better overview. The projections 18' and 18″ of the air nozzles 18 of the two rows into the table base plane parallel to the table surface subtend an angle between about 40° and 50°, preferably about 45°, with the transport direction A of the printing plate 17. These projections 18′ and 18″ are directed at this angle $\alpha$ towards the associated narrow sides 46 and 47 of the loading table 2. The same spatial arrangement is also present in the case of the air nozzles 18 of the exposure and developing tables 8 and 9.

The projections 18‴ and 18‴ of the air nozzles 18 of the two rows into a plane parallel to the longitudinal sides of the individual tables 2, 8 and 9 subtend an angle $\beta$ between about 40° and 50°, preferably about 45°, with the perpendicular direction towards the transport direction A of the printing plate 17.

The distance d between the flaps 5, raised to stand on their longitudinal edges, and the associated narrow sides 46 and 47 of the loading table 2 is about 3 to 6 mm. Flaps 5 comprise, for example, structural sheets with a thickness of about 1 mm.

The guide plates 21 and 22, which are arranged along the narrow sides 46 and 47 of the exposure table 8, form and enclose with these narrow sides, air channels 19 and 20 which have a width b of about 3 to 6 mm and a depth a of about 5 to 10 mm. These air channels between the swung-up flaps 5 and the narrow sides 46 and 47 of the loading table 2 on the one hand and the guide plates 21 and 22 and the narrow sides 46 and 47 of the exposure table 8 on the other hand ensure that space is available beneath the edges of the printing plate 17, into which space can flow excess transport air and that, moreover, a more powerful air cushion forms than under the remaining surface of the printing plate 17. This prevents the edges of the printing plate 17 from sagging downwards. The distance between the two rows of air nozzles 18 is about 35 to 50% of the distance between the raised flaps 5 or between the positionally fixed guide plates 21 and 22. In particular the distance between the rows is about 40% of the distance between the flaps or the guide plates. The two rows of air nozzles 18 are arranged symmetrically to the center line of each table in the transport direction A. In a row of air nozzles 18, the distance between two adjacent air nozzles can, for example, be about 25 mm, with the first and the last air nozzle 18 of a row being removed about 50 mm from the longitudinal sides. Although this is not shown, a strip made of sheet or foil material in each of the individual tables can bridge the gap between two tables.

Figure 4A:
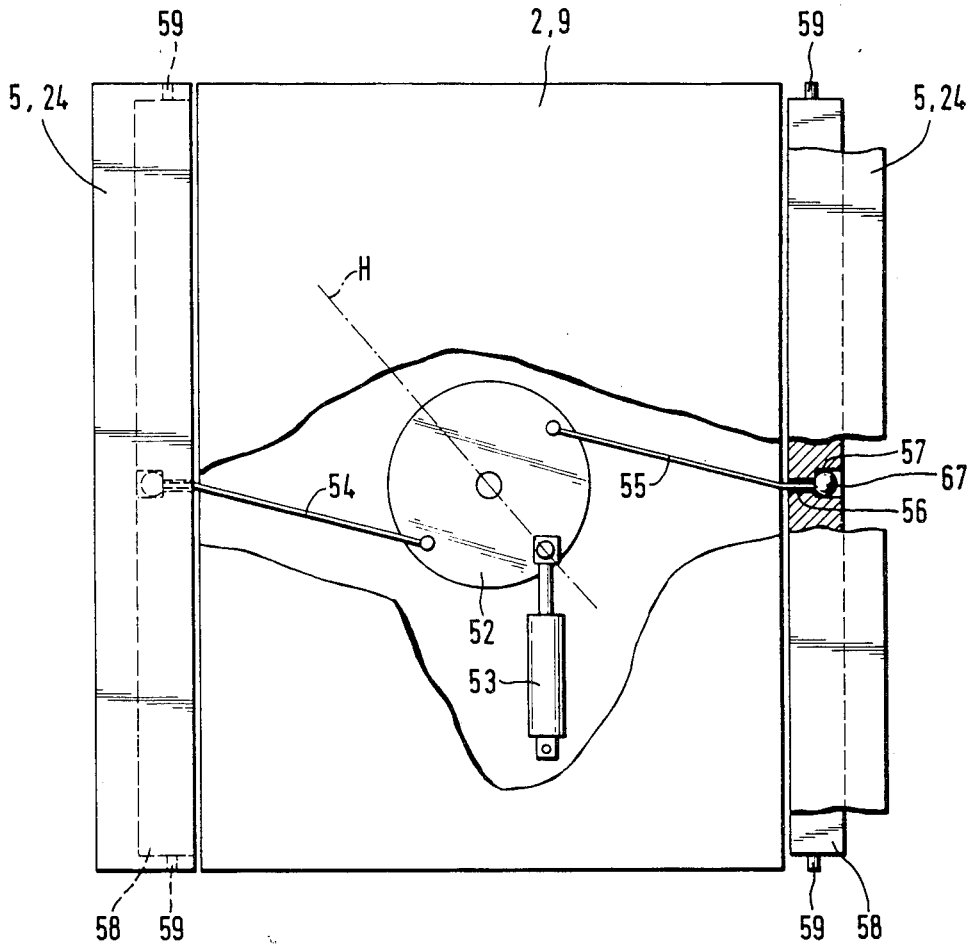
FIGS. 4*a* and 4*b* show details of an adjusting mechanism for flaps at the tables of the loding and development station.
Figure 4B:
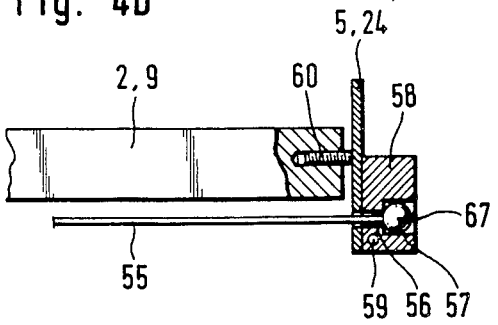

An adjusting mechanism for the flaps 5, which is identical to the adjusting mechanism for the flaps 24, is schematically shown in detail in FIGS. 4*a* and 4*b*. In plan view, the adjusting mechanism for the flaps 5 of the loading table 2 is located beneath the table 2. Likewise, the two adjusting mechanisms for the flaps 5 or 24 of the developing table 9 are attached beneath same. The adjusting mechanism includes a swivel plate 52, a pressure cylinder 53 acting on the swivel plate, and two strands 54 and 55 connecting the flaps to the swivel plate. The strands 54 and 55 can, for example, be sheathed steel wires. The strands 54 and 55 are engaged with one end on two diametrically opposite points next to the periphery of the swivel plate 52, whereas their other ends are fixed in stepped holes 56 and 57 of metal blocks 58. The orifice 56 has a smaller diameter than the orifice 57, in which is inserted the individual strand 54 or 55, which has a ball on its end. The ball has a larger diameter than the orifice 56, so that it is not possible to pull the strand out of the stepped orifices in the direction of the swivel plate 52. A flap 5 or 24 is attached to each metal block 58, with the metal block being swivellable about a pivot point 59 through an angle of up to about 90°. The pivot point 59 is distanced from the respective strand 54 or 55. The pressure cylinder 53, with its piston rod, is fixed near to the periphery of the swivel plate 52 to a point which lies on the segment bisector line H of the fixing points for the strands 54 and 55 on the swivel plate 52. FIG. 4*a* shows the extended position of the piston rod of the pressure cylinder 53, in which position the flaps 5 or 24 are placed upright and form a right angle with the surface of the respective table. If the piston rod of the pressure cylinder 53 is retracted, the swivel plate 52 turns in a clockwise direction, during which the strands 54 and 55 are pulled outwards, because the metal blocks 58 swivel outwards about the pivot points 59 and the flaps 5 or 24 connected to the metal blocks 58 are swung into the plane of the surface of the respective table. A stop 60, for example a screw, is attached to each of the narrow sides 46 and 47 of the loading table 2, as well as to all four side faces of the developing table 9, that is, to its narrow sides and longitudinal sides. The screw limits the swivel movement of the metal blocks 58 when the flaps are being swung upright. The pivot points 59 are in themselves made as axle stumps which are surrounded by spring clips (not shown) which ensure an elastic mounting of the individual flaps.

Figure 5:
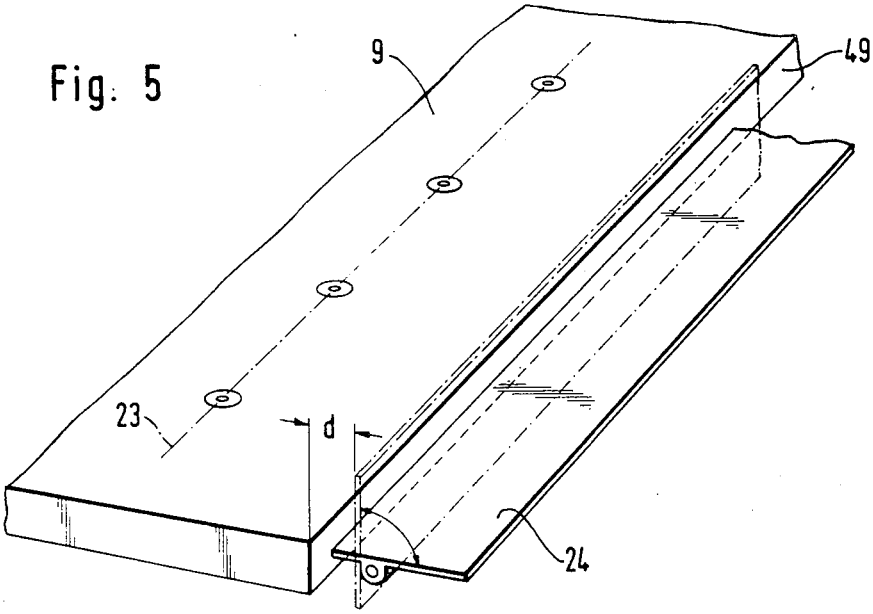
FIG. 5 shows a perspective view of a flap at the longitudinal side of the table of the exposure station.

FIG. 5 shows a perspective partial view of a flap 24 which is arranged parallel to the longitudinal side 49 of the developing table 9. The flap 24 is shown in the swung down position by solid lines, whereas the flap 24 placed upright is shown in chain-dotted lines. The distance d between the longitudinal side 49 and flap 24 positioned upright is about 3 to 6 mm.

Figure 6:
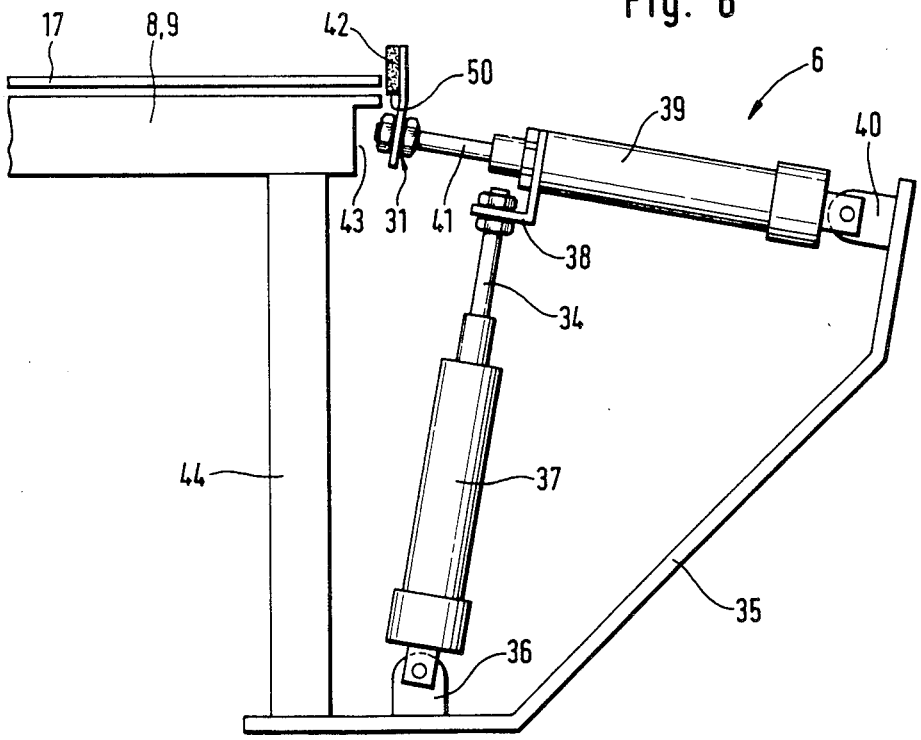
FIG. 6 shows a side view of a brake for stopping and positioning a printing plate on a table.

The brake 6 shown schematically in FIG. 6 comprises two pressure cylinders 37 and 39 which are articulated on bearing brackets 36 and 40 respectively of an angled mounting bar 35 of the brake. The mounting bar 35 is fixed to a distance piece 44 which extends downwards from the underside of the exposure table and the developing table 8 and 9, respectively. The piston rod 34 of one pressure cylinder 37 is connected via an angled connecting piece 38 to the other pressure cylinder 39, with the connecting piece 38 being directly fixed to the housing of the pressure cylinder 39. On the piston rod 41 of the pressure cylinder 39 is located a holder 31 which is equipped at its end with an elastic damping element 42, for example, of rubber. In the braking position shown, the lower edge 50 of the damping element is in alignment with the table surface. The damping element 42 brakes the printing plate 17 which is transported to the location in suspension on the air cushion. At the same time the damping element 42 springs back slightly, and then pushes the printing plate into the desired position. The transport air of the air nozzles is then switched off and the vacuum in the vacuum channels in the surface of the tables 8 and 9, respectively is switched on to suck the printing plate 17 in towards the surface. In the initial position of the brake 6, the two pressure cylinders 37 and 39 or their piston rods 34 and 41 are retracted. To initiate the braking operation, the piston rod 34 of the pressure cylinder 37 is extended first, and then the piston rod 41 of the pressure cylinder 39 is extended to bring the elastic damping element 42 into its braking position. The damping element 42 is swung out in the reverse sequence, that is, the piston rod 41 of the pressure cylinder 39 is retracted first and then the piston rod 34 of the pressure cylinder 37 is retracted. A clearance 43 in the form of a recessed cut-out in the longitudinal side of the relevant table is provided beneath the table surface at the location at which the brake 6 is provided. The cut-out enables the piston rod 41 of the pressure cylinder 39 to extend without hindrance into a position in which the damping element 42 brakes the printing plate 17 and can position the printing plate above the table.

Figure 7:
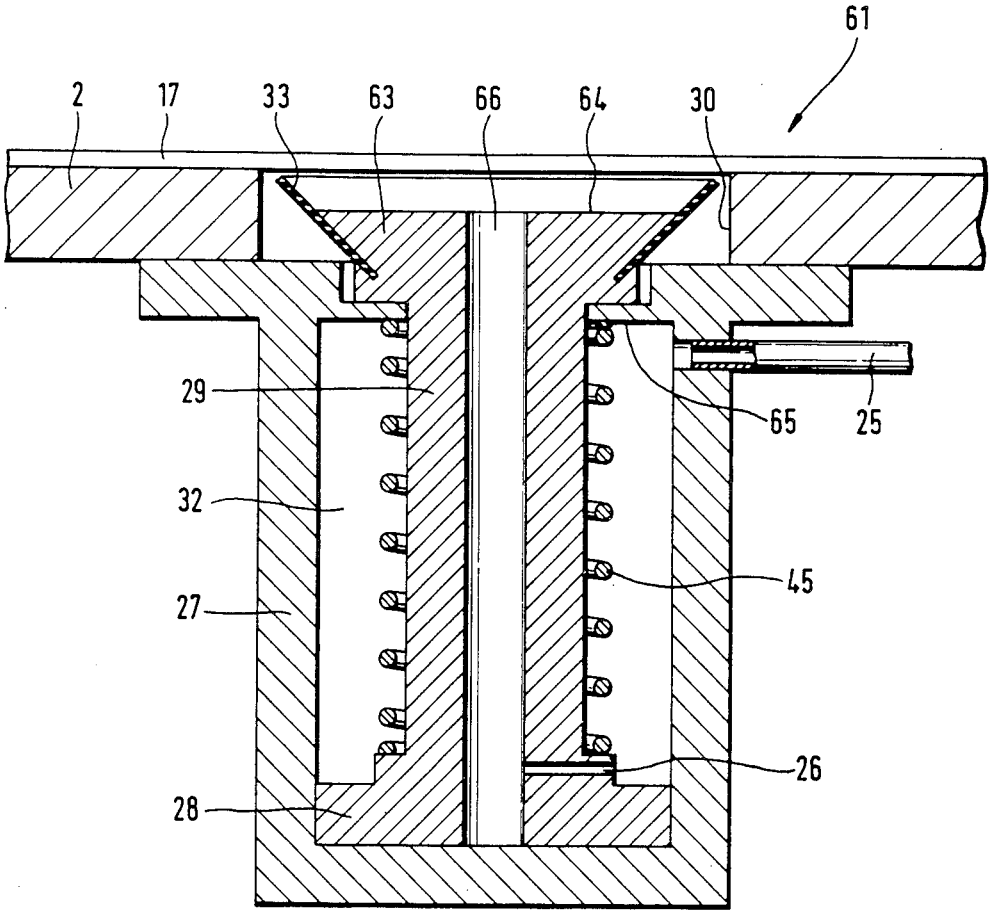
FIG. 7 shows a sectional view of a spring suction device for sucking in and raising a printing plate on or from the surface of the table of the loading station.

With reference to FIG. 7, the mode of operation of the spring suction device 61 known per se is briefly described. The spring suction devices 61 are arranged in the pivotable loading table 2 and in each case remove the uppermost printing plate from the plate magazine 1 (cf. FIG. 2). A cylindrical vacuum housing 27 of the spring suction device 61 on the underside of the loading table 2 comprises a displaceable piston 29. The piston base 28 of the piston 29 sits against the base and the inner wall of the vacuum housing 27 and seals a vacuum chamber 32 which extends between the piston 29 and the cylindrical inner wall of the vacuum housing 27. The vacuum chamber 32 is connected via a vacuum line 25 to a vacuum device (not shown). The piston 29 widens upwards into a truncated cone-shaped piston head 63 which projects into a clearance hole 30 of the loading table 2. A sleeve-like rubber seal 33 is inserted into an encircling bevelled groove of the piston head. The upper edge of the rubber seal 33 is in alignment with the table surface in the inoperative position of the spring suction device 61. A compression spring 45 surrounds the piston 29 and is supported against the upper side of the piston base 28 on the one hand, and against the inner side of an overlap face 65 of the vacuum housing 27 on the other hand.

A compensating bore 26 is located in the stepped piston base 28. The bore 26 connects the vacuum chamber 32 with a bore 66 to the piston 29. The bore 66 runs continuously in the axial direction.

A horizontal closure surtace 64 to the piston head 63 is located about 2 to 3 mm beneath the edge of the sleeve-shaped rubber seal 33 in the inoperative position of the spring suction device 61. In this position, a printing plate is not yet located on the loading table 2.

When the vacuum chamber 32 is evacuated via the vacuum line 25, the piston 29 moves upwards in the vacuum housing 27, because the piston base 28 seals against the cylindrical inner wall and the base of the vacuum housing 27. This upward movement of the piston comes about by atmospheric pressure prevailing in the bore 66, whereas there is a vacuum in the vacuum chamber 32, and because of the small diameter of the compensating bore 26, the pressure cannot at first be balanced between the bore 66 and the vacuum chamber 32. The atmospheric pressure in the bore 66 charges the underside of the piston base 28 with atmospheric pressure and thus presses the piston 29 upwards, since there is less pressure outside the piston 29 in the vacuum chamber 32 than in the bore 66. As soon as the closure surface 64 and the sleeve-shaped rubber seal 33 sit against the printing plate 17, the bore 66 is closed and the evacuation of the latter is initiated via the compensating bore 26. It the evacuation has advanced to the extent that the compression spring 45 can overcome the pressure which is still acting on the underside of the piston base 28 and is becoming smaller as evacuation advances, a jump-like downwards movement of the piston 29 into the suction position shown takes place under the effect of the pressure force exerted downwards by the compression spring 45 onto the upper side of the piston base 28. A corresponding vacuum then also prevails in the space enclosed by the rubber seal 33 and the closure surface 64 of the piston 29. By this means the printing plate 17 is sucked in by the spring suction device 61 and firmly held. The printing plate 17 is released as soon as the vacuum inside the vacuum chamber 32 is released. Subsequently, a new evacuation operation for the vacuum chamber 32 of the spring suction device 61 can be started.

The pressure cylinders of the device are preferably operated with compressed air, but the use of hydraulic cylinders is also possible.

What is claimed is:

1. A device for the electrophotographic manufacture of printing forms which are stacked in the form of printing plates in non-exposed condition in a magazine, individually removed from the magazine, and transported to a loading station and subsequently to further processing stations, comprising:

a plurality of tables sequentially aligned in the direction of transport of the printing plate; and a first set of at least two rows of air nozzles angularly positioned in each of said plurality of tables, said air nozzles being charged with compressed air, wherein said first set of at least two rows of air nozzles is aligned parallel to the transport direction of the printing plate, and wherein the projections of said air nozzles in a base plane parallel to the surfaces of the tables extend laterally at an angle of about 40° to 50° from the transport direction of the printing plate in the direction of the narrow sides of the particular table.

2. The device as claimed in claim 1, wherein the projections of said air nozzles in a plane parallel to the longitudinal sides of the particular table include an angle of about 40° to 50° with the vertical direction to the transport direction of the printing plate.

3. A device for the electrophotographic manufacture of printing forms which are stacked in the form of printing plates in non-exposed condition in a magazine, individually removed from the magazine, and transported to a loading station and subsequently to further processing stations, comprising:

a plurality of tables sequentially aligned in the direction of transport of the printing plate; and a first set of at least two rows of air nozzles angularly positioned in each of said plurality of tables, said air nozzles being charged with compressed air, wherein said first set of at least two rows of air nozzles is aligned parallel to the transport direction of the printing plate, and wherein said plurality of tables includes a loading table, an exposing table, and a developing table, said loading table and said developing table further comprising pivotable flaps positioned at a distance of about three to six millimeters along the narrow sides of said tables.

4. The device as claimed in claim 3, wherein said exposing table further comprises fixed guide plates positioned along the narrow sides of said table.

5. The device as claimed in claim 3, wherein the distance between said two rows of air nozzles is about 35–50% of the distance between said flaps.

6. The device as claimed in claim 3, wherein the distance between said two rows of air nozzles is about 35–50% of the distance between said guide plates.

7. The device as claimed in claim 3, wherein said developing table comprises a second set of pivotable flaps positioned along the longitudinal sides of said table.

8. The device as claimed in claim 7, further comprising an adjusting mechanism for swivelling said flaps, said adjusting mechanism comprising a swivel plate, a pressure cylinder engaging said swivel plate and two strands which connect said flaps to said swivel plate.

9. The device as claimed in claim 3, wherein said developing table includes a second set of at least two rows of air nozzles, said nozzles extending transversely to the transport direction of the printing plate.

10. The device as claimed in claim 3, wherein each of said exposing table and said developing table includes an adjustable brake positioned along the distal longitudinal side of said table in the transport direction.

11. The device as claimed in claim 3, further comprising an adjusting mechanism for swivelling said flaps, said adjusting mechanism comprising a swivel plate, a pressure cylinder engaging said swivel plate and two strands which connect said flaps to said swivel plate.

12. The device as claimed in claim 11, further comprising two metal blocks comprising stepped orifices, wherein said two strands are fixed at one end to two diametrically opposite points near the periphery of said swivel plate and at the other end in said stepped orifices.

13. A device for the electrophotographic manufacture of printing forms which are stacked in the form of printing plates in non-exposed condition in a magazine, individually removed from the magazine, and transported to a loading station and subsequently to further processing stations, comprising:

a plurality of tables sequentially aligned in the direction of transport of the printing plate; and a first set of at least two rows of air nozzles angularly positioned in each of said plurality of tables, said air nozzles being charged with compressed air, wherein said plurality of tables includes a loading table, an exposing table and a developing table, wherein said exposing table further comprises fixed guide plates positioned along the narrow sides of said table, and further comprising air channels having a depth of about 5 to 10 mm and a width of about 3 to 6 mm, said air channels being formed between said fixed guide plates and said narrow sides.

14. A device for the electrophotographic manufacture of printing forms which are stacked in the form of printing plates in non-exposed condition in a magazine, individually removed from the magazine, and transported to a loading station and subsequently to further processing stations, comprising:

a plurality of tables sequentially aligned in the direction of transport of the printing plate; and a first set of at least two rows of air nozzles angularly positioned in each of said plurality of tables, said air nozzles being charged with compressed air, wherein said plurality of tables includes a loading table, an exposing table and a developing table, wherein each of said exposing table and said developing table includes an adjustable brake positioned along the distal longitudinal side of said table in the transport direction, and wherein said brake comprises a distance piece connected to the underside of said exposing and developing tables, an angled mounting bar fixed to said distance piece, two bearing brackets extending from said mounting bar, and two pressure cylinders, articulated on said bearing brackets, and including a piston rod.

15. The device as claimed in claim 14, further comprising a bent connecting piece which connects said piston rods of said pressure cylinders, a holder fixed to one of said piston rods, and a damping element attached to said holder, wherein said damping element includes a lower edge aligned with the surface of said tables in the braking position of said damping element.

* * * * *